US010716726B2

(12) United States Patent
Bergman et al.

(10) Patent No.: US 10,716,726 B2
(45) Date of Patent: Jul. 21, 2020

(54) SYSTEM AND APPARATUS FOR REACTING MOMENTS ON A BED RAIL

(71) Applicant: Corindus, Inc., Waltham, MA (US)

(72) Inventors: Per Bergman, West Roxbury, MA (US); Benjamin Piecuch, Providence, RI (US); Adam Young, Dedham, MA (US); Eric Klem, Lexington, MA (US)

(73) Assignee: CORINDUS, INC., Waltham, MA (US)

( * ) Notice: Subject to any disclaimer, the term of this patent is extended or adjusted under 35 U.S.C. 154(b) by 566 days.

(21) Appl. No.: 15/344,202

(22) Filed: Nov. 4, 2016

(65) Prior Publication Data

US 2017/0143572 A1 May 25, 2017

Related U.S. Application Data

(60) Provisional application No. 62/253,071, filed on Nov. 9, 2015.

(51) Int. Cl.
*A61G 13/10* (2006.01)
*A61G 7/05* (2006.01)

(52) U.S. Cl.
CPC ..... *A61G 13/101* (2013.01); *A61G 7/05* (2013.01)

(58) Field of Classification Search
CPC .... A47C 21/00; A61G 13/101; A61G 7/0503; A61G 7/05; A61B 90/50; A61B 2090/5025; A61B 2090/504; A61B 2090/571; F16M 2200/022; F16M 2200/08; B25B 1/2468; B25B 1/2457; B25B 1/2494; B25B 5/003
See application file for complete search history.

(56) References Cited

U.S. PATENT DOCUMENTS 3,046,072 A * 7/1962 Douglass, Jr. ..... A61G 13/12 5/623
4,524,475 A 6/1985 Valentino
4,984,568 A 1/1991 Persaud
5,926,876 A * 7/1999 Haigh ..... A61G 13/12 5/616
6,152,435 A * 11/2000 Snell ..... B25B 1/20 269/268
6,266,831 B1 * 7/2001 Heimbrock ..... A61G 1/04 248/231.61
6,350,089 B1 2/2002 Tekavec
6,499,158 B1 * 12/2002 Easterling ..... A61G 15/10 248/231.61
6,685,176 B2 * 2/2004 Wirth, Jr. ..... B25B 1/103 269/147
7,114,714 B2 * 10/2006 Wong ..... B23K 37/04 269/45
7,293,305 B2 11/2007 Metz et al.
7,520,007 B2 * 4/2009 Skripps ..... A61G 13/04 24/459
7,802,503 B2 * 9/2010 Couvillion ..... B26D 1/08 269/87.2

(Continued)

*Primary Examiner* — Robert G Santos
*Assistant Examiner* — Alexis Felix Lopez
(74) *Attorney, Agent, or Firm* — Rathe Lindenbaum LLP

(57) ABSTRACT

A rail system for a medical table includes a frame, a rail coupled to the frame and an apparatus for reacting a moment on the rail. The apparatus is operatively secured to a first position on the rail and is configured to apply a first moment on the rail to counteract a second moment applied to the rail.

20 Claims, 10 Drawing Sheets

(56) References Cited

U.S. PATENT DOCUMENTS

| | | | | |
|---|---|---|---|---|
| 8,485,509 | B2 * | 7/2013 | Wang | B25J 15/00 269/249 |
| 8,621,692 | B1 * | 1/2014 | Kring | A61G 13/101 248/228.3 |
| 9,022,334 | B1 * | 5/2015 | DeMayo | F16M 13/022 248/229.22 |
| 2003/0155478 | A1 * | 8/2003 | Easterling | A61G 15/10 248/316.1 |
| 2006/0290515 | A1 * | 12/2006 | Kankkunen | F16M 11/08 340/572.8 |
| 2010/0270525 | A1 | 10/2010 | Erwin | |
| 2010/0299890 | A1 * | 12/2010 | Doyle | A61G 7/05 24/457 |
| 2012/0126079 | A1 * | 5/2012 | Russell | A61G 13/101 248/229.23 |
| 2014/0007408 | A1 * | 1/2014 | Nool | B65D 25/22 29/525.01 |
| 2014/0205371 | A1 * | 7/2014 | Bally | A61G 12/008 403/327 |
| 2015/0238377 | A1 | 8/2015 | Muhammad | |
| 2016/0270995 | A1 * | 9/2016 | Carter | A61G 13/10 |

* cited by examiner

SYSTEM AND APPARATUS FOR REACTING MOMENTS ON A BED RAIL

CROSS REFERENCE TO RELATED APPLICATIONS

The present application claims the benefit of U.S. Provisional Application Ser. No. 62/253,071, filed Nov. 9, 2015 entitled RAIL ACCESSORY, which is herein incorporated by reference in its entirety.

FIELD OF THE INVENTION

The present invention relates generally to the field of medical beds and more particularly, to a rail system for a medical bed including an apparatus for reacting moments on the rail.

BACKGROUND OF THE INVENTION

Medical beds or tables used in hospitals, clinics, doctor offices or other medical environments may include a rail operatively secured to the bed for supporting various medical instrumentation. The rail may be used to secure a robotic catheter system as illustrated in U.S. Pat. No. 8,480,618 entitled Catheter System incorporated herein by reference in its entirety. A medical device mounted to the rail can apply a force on the rail that may cause torsional deflection of the interface between the rail and the frame of the bed or table.

It would be desirable to provide an apparatus for reacting moments on a rail of a medical bed and to provide support to the rail when the rail is used to support medical instruments.

SUMMARY OF THE INVENTION

In accordance with an embodiment, a rail system for a medical table includes a frame, a rail coupled to the frame and an apparatus for reacting a moment on the rail, the apparatus operatively secured to a first position on the rail and configured to apply a first moment on the rail to counteract a second moment applied to the rail.

In accordance with another embodiment, an apparatus for reacting a moment on a rail of a medical table, the rail configured to support at least one medical instrument, includes a rail clamp member, a base block member moveably coupled to the rail clamp member, a first fastening device and a second fastening device operatively coupled to the rail clamp member and the base block member and configured to moveably couple the base block member to the rail clamp member, a fastener disposed within an aperture in the rail clamp member and an aperture in the base block member, the fastener having a first end and second end, and a spacer operatively coupled to the second end of the fastener and movable to apply a first moment to react a second moment on the rail of the medical table.

In accordance with another embodiment, an apparatus for reacting a moment on a rail of a medical table, the rail configured to support at least one medical instrument, includes a base block member, having a first aperture and a second aperture, a first fastening device disposed within the first aperture, a spacer operatively coupled to the first fastening device and movable to apply a first moment to react a second moment on the rail of the medical table and a second fastening device disposed within the second aperture to attach the base block to the rail.

BRIEF DESCRIPTION OF THE DRAWINGS

This application will become more fully understood from the following detailed description, taken in conjunction with the accompanying figures, wherein like reference numerals refer to like elements in which.

DETAILED DESCRIPTION OF THE PREFERRED EMBODIMENTS

Figure 1:
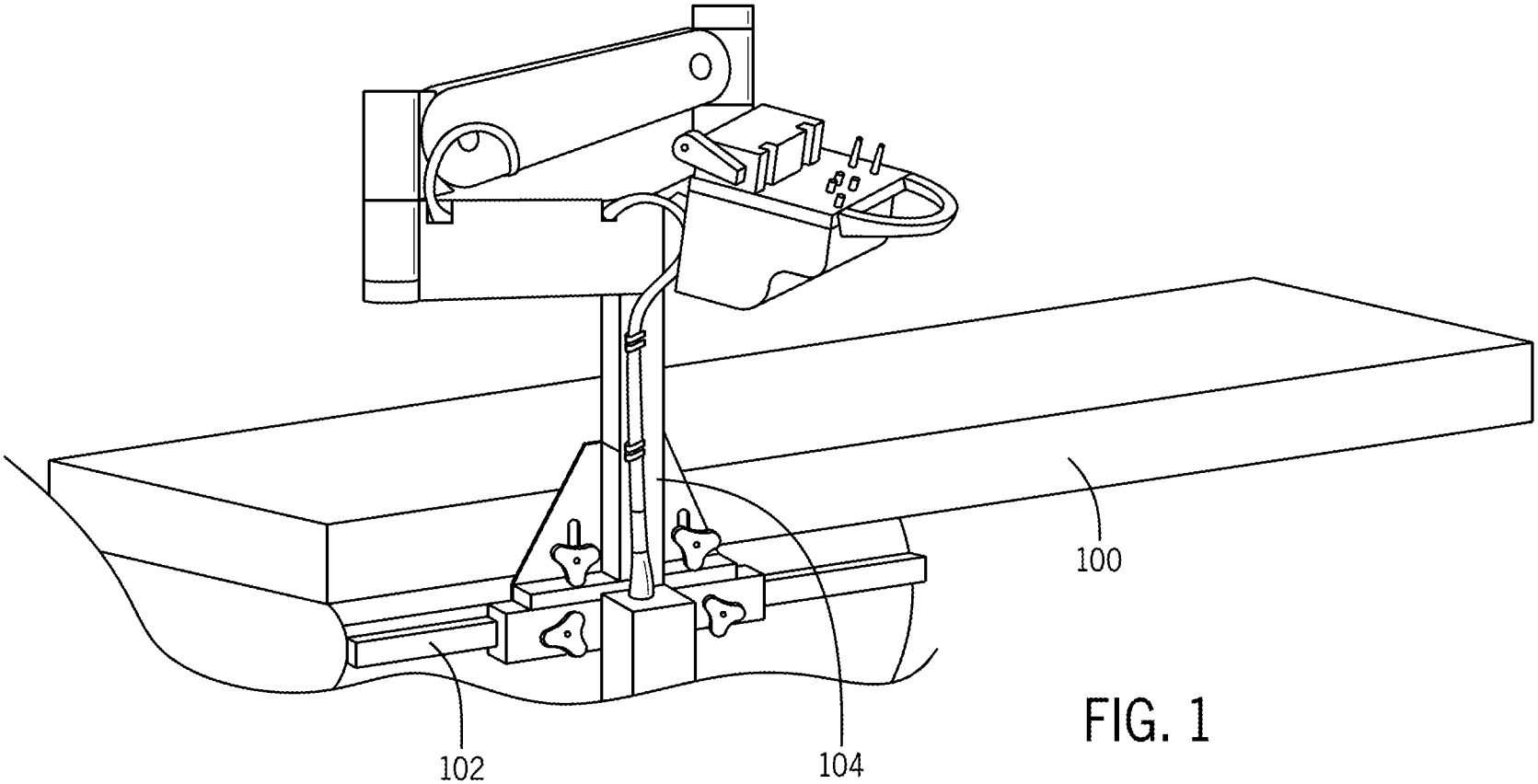
FIG. 1 is a schematic diagram of an exemplary medical bed with a medical instrument in accordance with an embodiment.

FIG. 1 is a schematic diagram of an exemplary medical bed or table with a medical instrument in accordance with an embodiment. In FIG. 1, a medical bed or table 100 includes a rail 102. A medical instrument 104 is mounted to the bed 100 using the rail 102, for example, the medical instrument 104 may be secured to the rail 102 using a clamp or clamps. The medical instrument 104 may be, for example, a robotic catheter system, an IV pole, a monitor, a contrast solution injector, etc. The medical instrument 104 may place a moment on the rail 102 that may cause torsional deflection of the rail 102 and the interface between the rail 102 and the frame of table 100.

In the following description, the vertical direction is the direction parallel to the direction of gravity and the horizontal direction is a direction generally perpendicular to the direction of gravity. The term upward will be a vertical direction opposite the direction of the force of gravity and the term downward will be a vertical direction in the direction of gravity. These directions will apply as described herein when bed 104 is in an orientation such that the table portion of the bed 104 in which a patient lies is in a horizontal orientation. The term moment refers to a force at a distance, namely, a lever arm.

Figure 2:
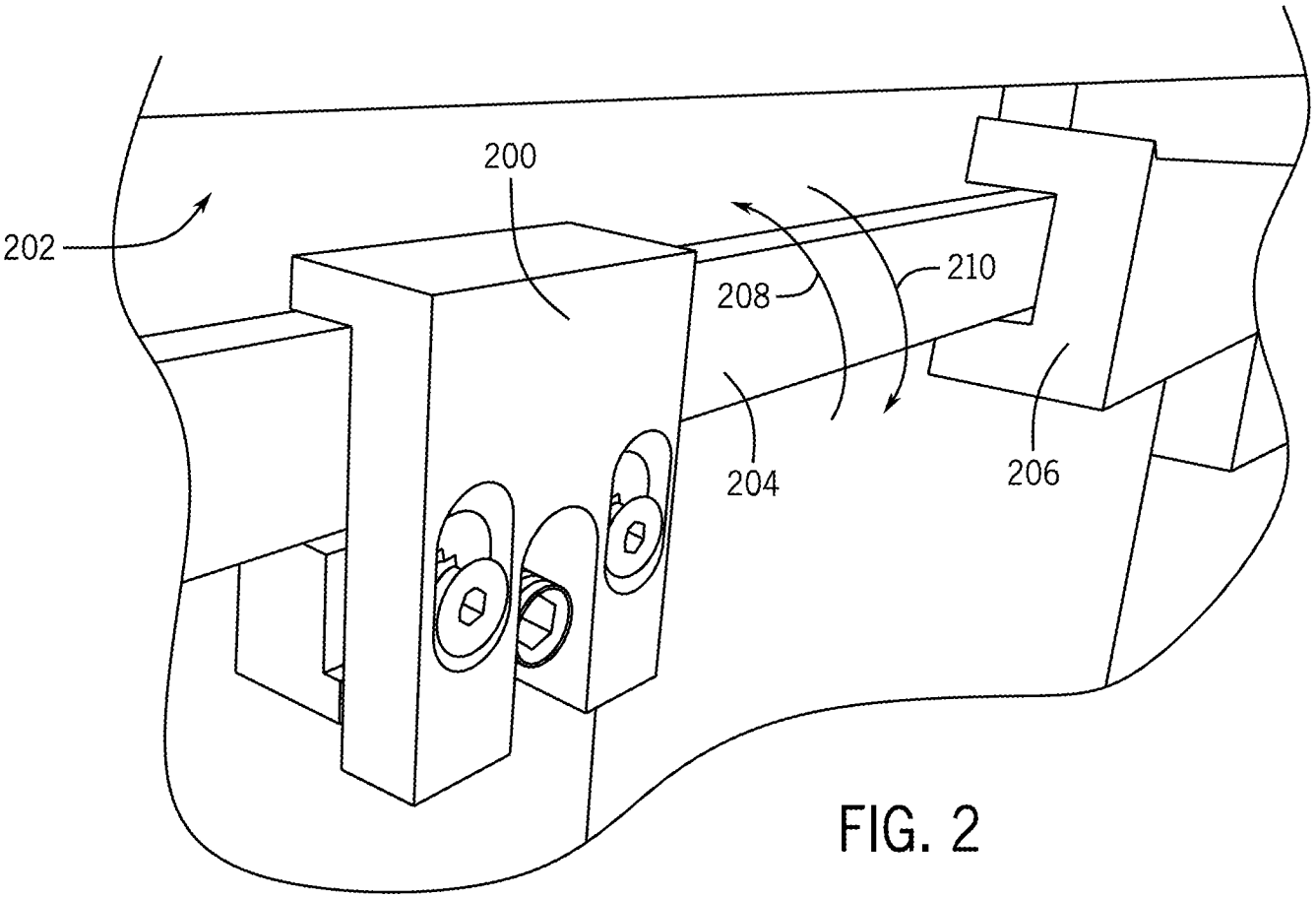
FIG. 2 is a schematic diagram of an apparatus for reacting a moment on a rail that is mounted on a medical table rail in accordance with an embodiment.

FIG. 2 is a schematic diagram of an apparatus for reacting a moment on a rail that is mounted on a medical table rail in accordance with an embodiment. In FIG. 2, a medical instrument 206 is mounted to or secured to a rail 204 of a bed or table 202, for example, by using clamps or other mounting structure. In addition, an apparatus 200 for reacting a moment is secured onto the rail 204. The apparatus 200 is configured to provide support to the rail 204 and maintain the alignment of the rail 204 with the table 202 by asserting a restorative moment on the rail 204 and the structural elements of the table 202. As described in detail below, the apparatus 200 counteracts the moment applied by the medical instrument 206 on the rail 204. A moment 208 is created by the apparatus 200 to counter the moment 210 of the medical instrument 206 secured to another portion of the rail 204. The apparatus 200, for example, may be arranged to provide a moment in the direction 208 that is opposite to the direction 210 of the moment applied by the medical instrument 206. A force applied by the apparatus 200 places a moment on the rail that may support and strengthen the rail by, for example, mitigating the torsional deflection on the rail. In one embodiment, the apparatus 200 serves to lengthen the moment arm and reduce the axial load on, for example, the mounting hardware, e.g., bolts (not shown), used to attach the rail 204 to the table 202. In another embodiment, the force applied by the medical instrument 206 may place the bolts or other mounting hardware of the rail in bending. The apparatus 200 may be used to take the bolts out of bending and place them in tension to react the moment.

Figure 3:
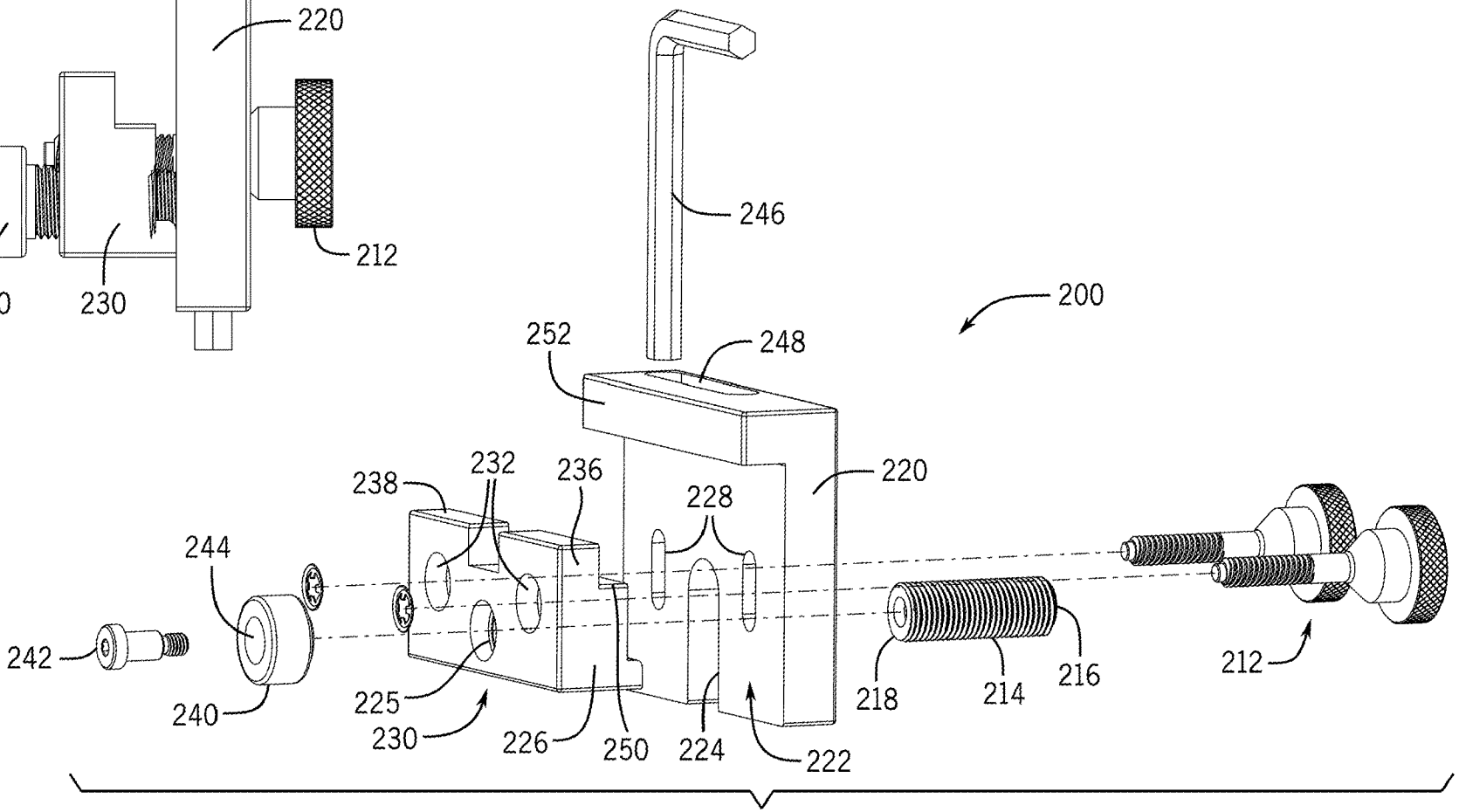
FIG.3 is an exploded view of an apparatus for reacting a moment on a rail in accordance with an embodiment.

FIG. 3 is an exploded view of an apparatus for reacting a moment on a rail in accordance with an embodiment. Apparatus 200 is configured to react a moment along the long axis of the rail 204 (shown in FIG. 2). In FIG. 3, the apparatus 200 for reacting a moment includes a rail clamp member 220 and a base block member 230. Base block member is moveably secured to the rail clamp member 220. As shown in FIG. 3, rail clamp member 220 includes a pair of slots 228 having a longitudinal axis extending vertically in the in-use orientation. In alternative embodiments, one slot or more than two slots may be used. A pair of thumb screws 212, or other fasteners known in the art, extend through the pair of slots 228, respectively, and through a matching pair of threaded apertures 232 in the base block 230. A fastener 214 includes male threads, a first end 216 and a second end 218. The first end 216 of fastener 214 includes an opening that may be used to receive a hex key or Allen key 246 as described further below with respect to FIGS. 7-9. The second end 218 of fastener 214 includes a female threaded portion extending therein toward the first end 216. The fastener 214 extends through an aperture 224 in rail clamp member 220 and is received within aperture 225 of base block 230. A spacer 240 is rotatably secured to the second end 218 of fastener 214 with a threaded member 242. In one embodiment, spacer 240 is fabricated from aluminum to prevent the spacer 240 from marring the finished surface of table 202 (shown in FIG. 2). However, other materials are contemplated. In another embodiment, pads 244 with brushings may be used on the fastener 214 and spacer 240 to prevent damage to the table 202 (shown in FIG. 2).

Figure 4:
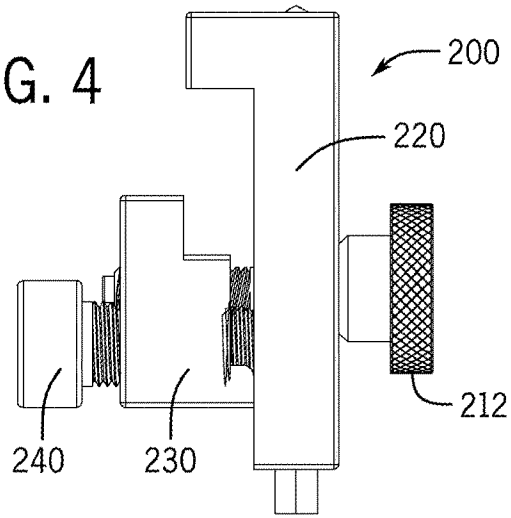
FIG. 4 is a side view of the apparatus in FIG. 3 in accordance with an embodiment.

FIG. 4 is a side view of the apparatus in FIG. 3 in accordance with an embodiment. FIG. 4 shows the apparatus 200 for reacting a moment with the rail clamp member 220 secured to the base block member 230 using the pair of thumb screws 212. As described below, a hex key 246 (shown in FIG. 3) may be inserted into the first end 216 of fastener 214 to adjust the position of the spacer 240 towards the table 202 to preload the rail 204 (shown in FIG. 2).

Figure 5:
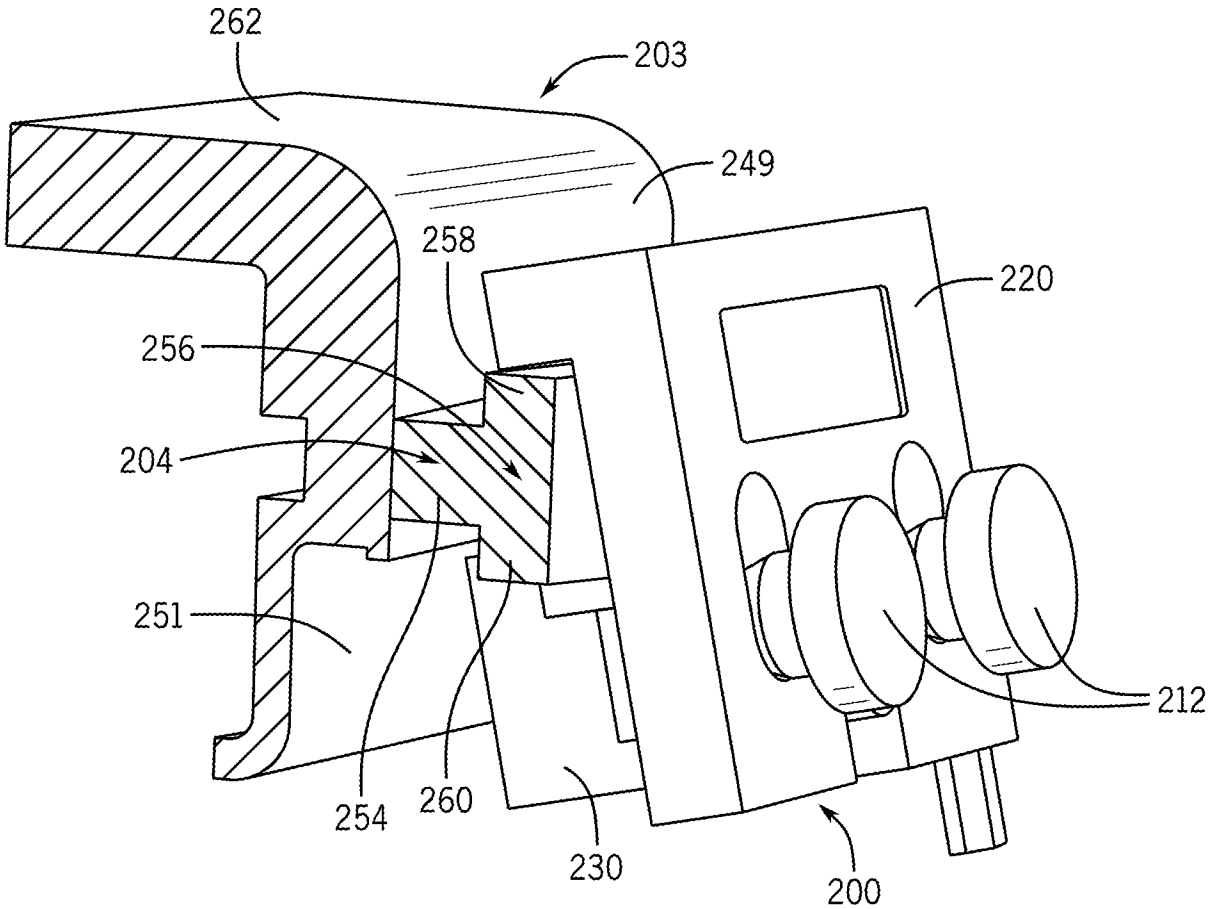
FIG. 5 is a schematic isometric view of the apparatus of FIG. 3 being secured to the rail in accordance with an embodiment.

A method for securing the apparatus for reacting a moment will be described with reference to FIGS. 3-9. Referring to FIGS. 3 and 5, a portion of a frame 203 of a bed or table 202 (shown in FIG. 2) has an upper surface 262, and an outer periphery having a first vertical portion 249 extending from the upper surface 260 and a second vertical portion 251 extending parallel to the first vertical position 249 but jogged inwardly a predetermined distance. A rail 204 is mounted on the frame 203, for example, using a fastener such as bolts (not shown). In one embodiment, the rail 204 has a T-shaped cross section with a first leg 254 extending horizontally from first vertical portion 249 of frame 203 and a second leg 256 extending generally parallel to the first vertical portion 249 of frame 203 and perpendicular to the first leg 254 of the rail 204. The second leg 256 of rail 204 includes a first free end 258 and a second free end 260. The apparatus 200 for reacting a moment is secured to the rail 204 by first loosely securing the rail clamp member 220 to the base block 230 with thumb screws 212. An upper wall 236 of the base block 230 is placed between the second vertical portion 251 of the frame 203 and the second leg 256 of the rail 204. A lip portion 250 of the base block 230 is positioned adjacent the second free end 260 of the second leg 256 of rail 204 and a top portion 252 of the rail clamp member 220 is positioned adjacent the first free end 258 of the second leg 256 of rail 204. The top portion 252 of rail clamp member 220 extends inwardly towards the frame 203.

Figure 6:
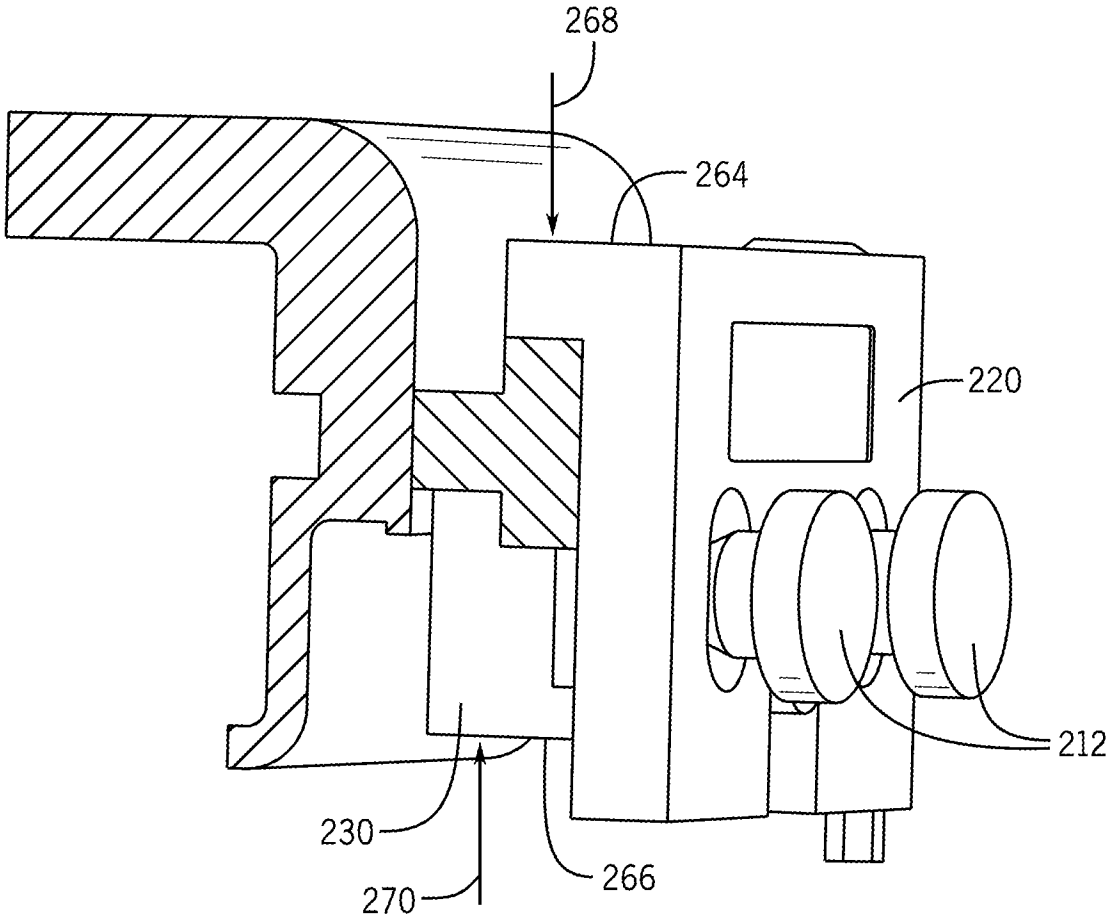
FIG. 6 is a schematic isometric view of the apparatus of FIG. 3 being secured to the rail in accordance with an embodiment.

Referring to FIGS. 3 and 6, the thumb screws 212 are rotated to move the rail clamp member 220 and base block 230 into a vertical orientation where the upper wall 236 of base block 230 and a lower portion or surface 266 of the base block 230 are adjacent an inward surface 222 of the rail clamp member 220. A user applies a downward pressure in vector direction 268 on an upper surface 264 of the rail clamp member 220 and an upper pressure in vector direction 270 to a lower surface 266 of base block 230 such that an upper surface 238 of base block 230 is adjacent to a lower surface of the first leg 254 of the rail 204 and such that a lower surface 253 of the inwardly extending top portion 252 of rail clamp member 220 is adjacent to the first free end 258 of the second leg 256 of rail 204.

Figure 7:
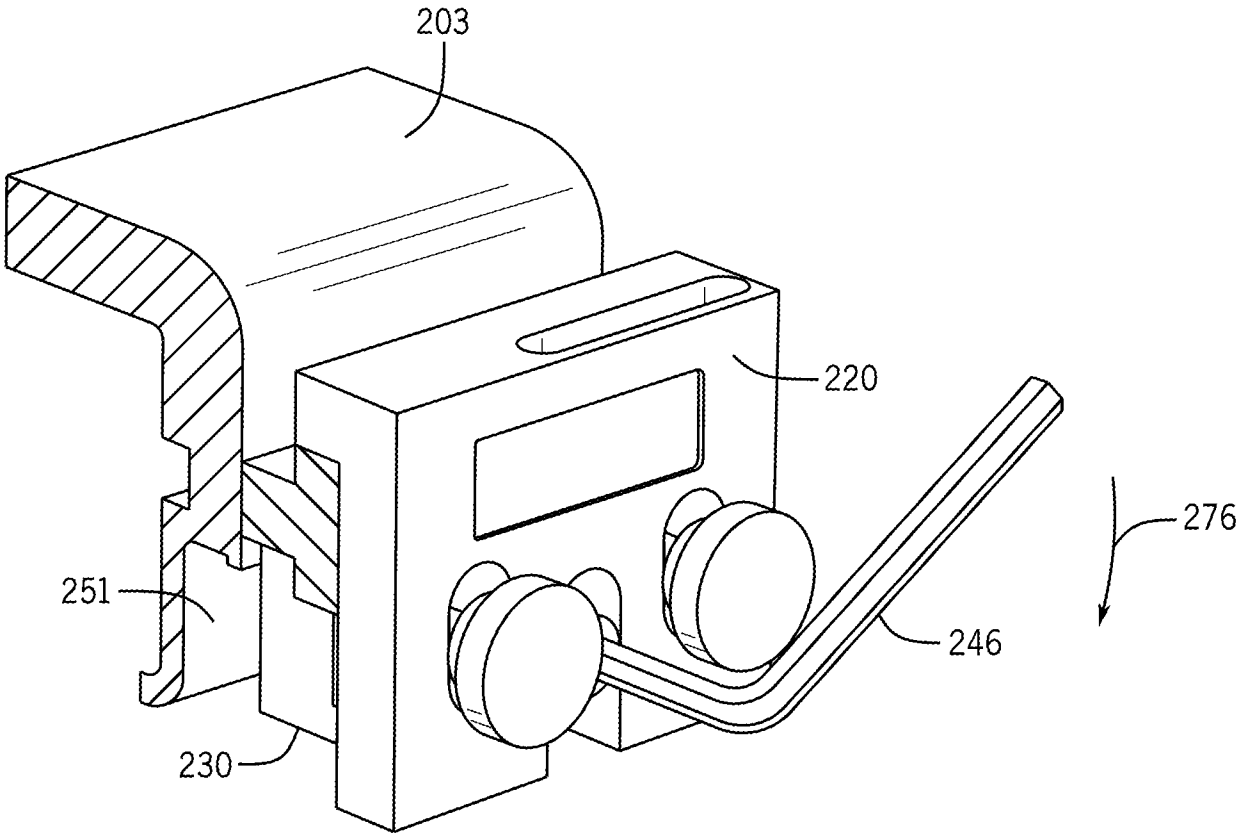
FIG. 7 is a schematic isometric view of the apparatus of FIG. 3 being secured to the rail in accordance with an embodiment.
Figure 8:
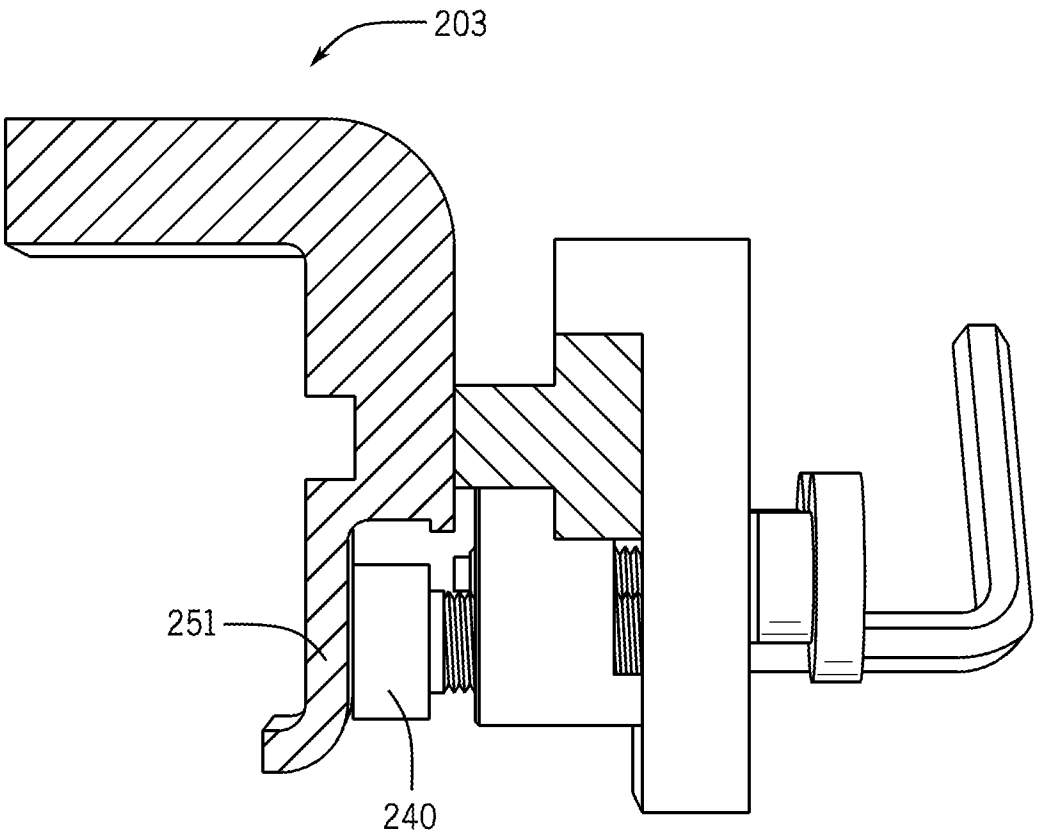
FIG. 8 is a schematic side view of the apparatus of FIG. 3 being secured to the rail in accordance with an embodiment.
Figure 9:
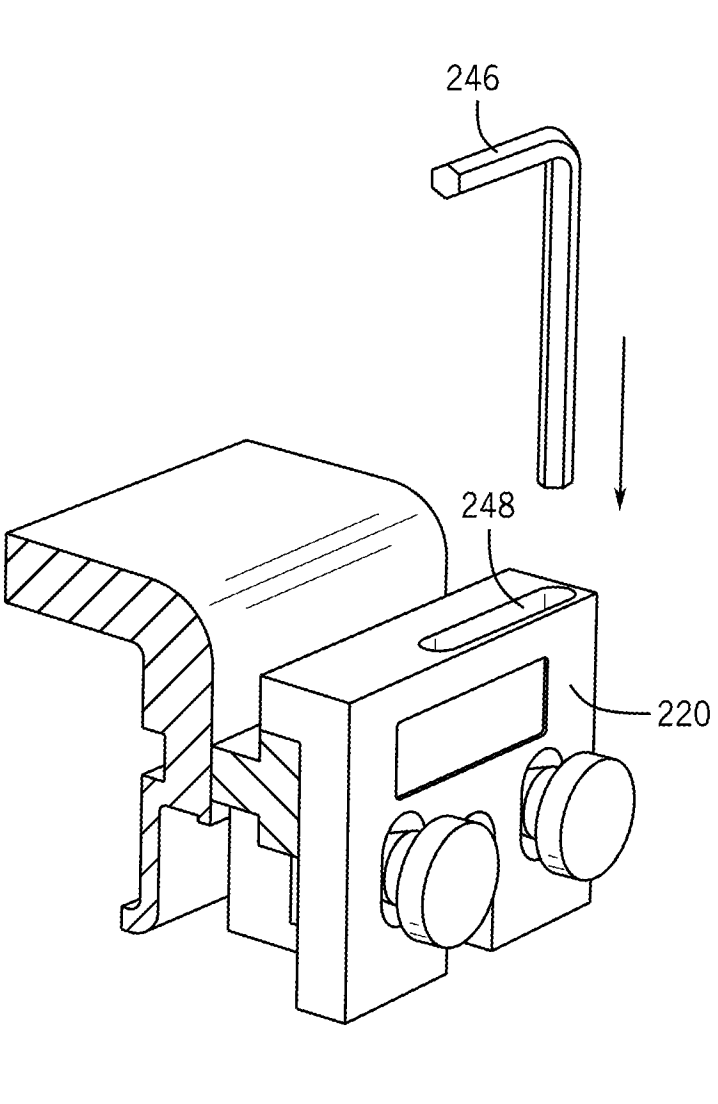
FIG. 9 is a schematic isometric view of the apparatus of FIG. 3 secured to the rail.

Referring to FIGS. 3, 7 and 8, a hex key 246 is inserted into the first end 216 of fastener 216 and rotated in a direction 276 to rotate the spacer 240 against the second vertical portion 251 of frame 203 to apply a force that creates a moment. In this manner, a moment is created to counter the moment of a medical instrument secured to another portion of the rail. As shown in FIGS. 3 and 9, the rail clamp member 220 may include an aperture 248 that may be used to store the hex key 248.

Figure 12:
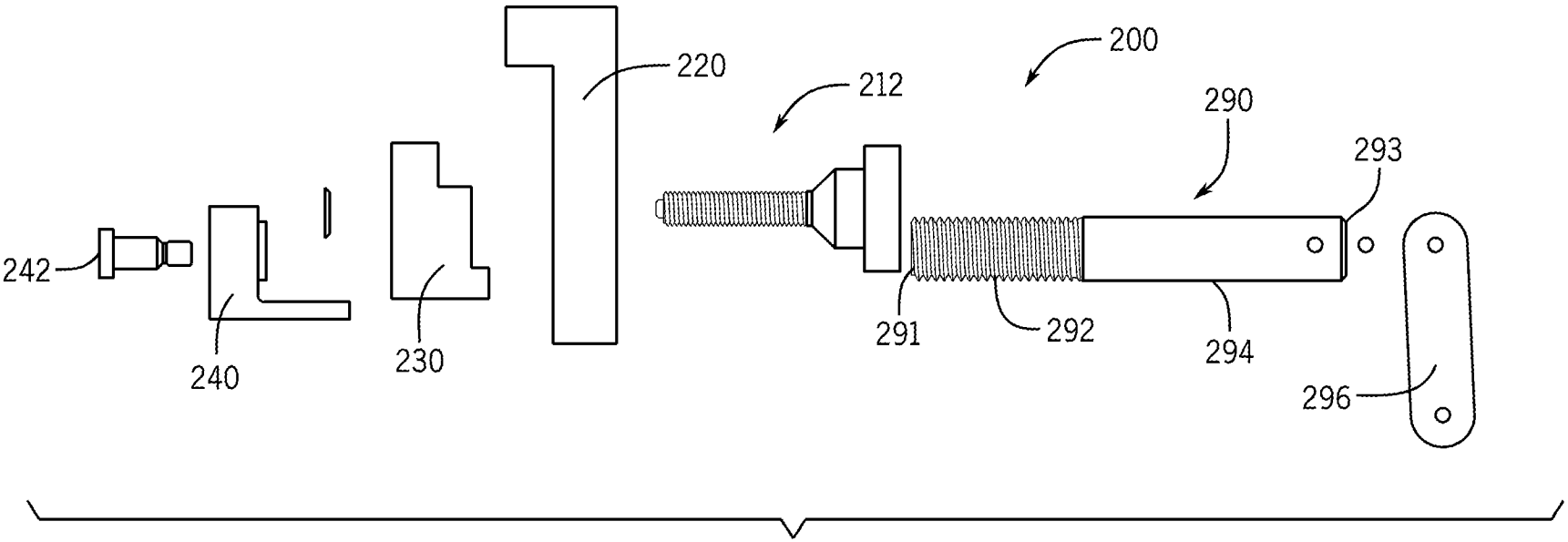
FIG. 12 is an exploded view of an apparatus for reacting a moment on a rail in accordance with an alternative embodiment.

FIG. 12 is an exploded view of an apparatus for reacting a moment on a rail in accordance with an alternative embodiment. In the embodiment shown in FIG. 12, the fastener 214 shown in FIG. 2 is replaced with a rotatable arm 290. The rotatable arm 290 has a first end 291, a threaded portion 292, a second end 293 and an extension portion 294. A handle 296 is connected to the second end 293 of the rotatable arm 290. The first end 291 of the rotatable arm 290 includes a female threaded portion extending therein toward the second end 293. The threaded portion 292 of rotatable arm 290 extends through an aperture 224 (shown in FIG. 3) in the rail clamp member 220 and is received within aperture 225 (shown in FIG. 3) of base block 230. A spacer 240 is rotatably secured to the first end 291 of the rotatable arm 290 with a threaded member 242. The handle 296 may be used to rotate rotatable arm 290 and adjust the position of the spacer 240 towards the table 202 to preload the rail 204

(shown in FIG. 2). In this manner, a moment is created to counter the moment of a medical instrument secured to another portion of the rail.

Figure 10:
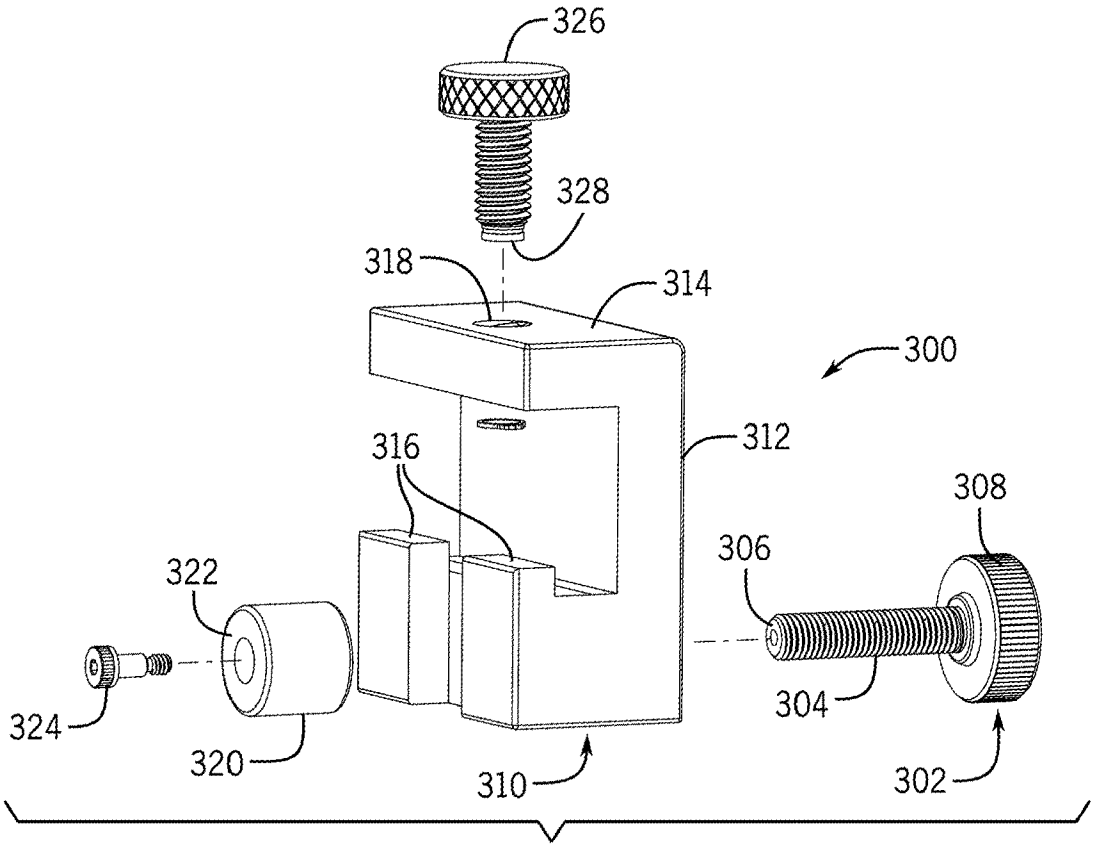
FIG. 10 is an exploded view of an apparatus for reacting a moment on a rail in accordance with an embodiment.
Figure 11:
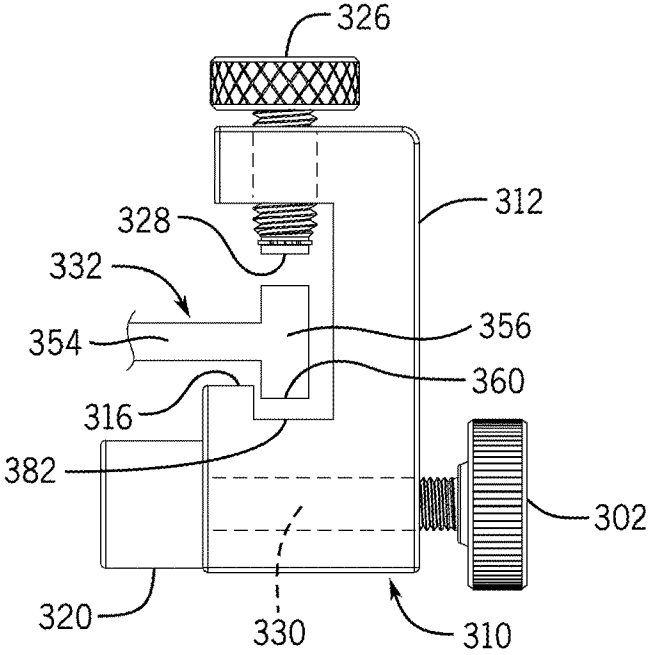
FIG. 11 is a side view of the apparatus in FIG. 10 in accordance with an embodiment.

A second embodiment of an apparatus for reacting a moment on a rail is shown in FIGS. 10 and 11. Apparatus 300 is configured to react a moment along the short side of the rail 204 (shown in FIG. 2). In FIG. 10, an apparatus 300 for reacting a moment on a rail includes a base block member 310 including an external vertical surface 312 and a top horizontal surface 314. A first thumb fastener 302 having a male threaded portion 304 extends through a threaded aperture 330 (shown in FIG. 11). The first thumb fastener 302 has a free end 306 having a female threaded region extending therein toward a thumb fastener end 308. Male threaded region 304 extends through a spacer 320 and a fastener 324 is rotatably secured to the female threaded portion of the first thumb screw 302. A second thumb screw 326 is threadably secured through top surface 314 into a threaded aperture 318.

Apparatus 300 may be secured to a rail 332 such that legs 316 of base block member 310 contact a vertical portion of the second free end 360 of the second leg 356 of the rail 332 and the second free end 360 contacts a recess 382 of the base block 310. First thumb screw 302 is rotated to operatively secure a free face 322 (shown in FIG. 10) of spacer 320 against a second vertical portion 256 (shown in FIG. 5) of the frame 203 (shown in FIG. 5). In this manner, a moment is created to counter the moment of a medical instrument secured to another portion of the rail. In one embodiment, pads with brushings may be used on the fastener spacer 320 to prevent damage to the table 202 (shown in FIG. 2). The second thumb screw 326 is rotated so that the free end 328 of the second thumb screw 326 makes contact with the second leg 356 of the rail 332.

This written description used examples to disclose the invention, including the best mode, and also to enable any person skilled in the art to make and use the invention. The patentable scope of the invention is defined by the claims, and may include other examples that occur to those skilled in the art. Such other examples are intended to be within the scope of the claims if they have structural elements that do not differ from the literal language of the claims, or if they include equivalent structural elements with insubstantial differences from the literal language of the claims. The order and sequence of any process or method steps may be varied or re-sequenced according to alternative embodiments.

Many other changes and modifications may be made to the present invention without departing from the spirit thereof. The scope of these and other changes will become apparent from the appended claims.

What is claimed is:

1. A rail system for a medical table, the rail system comprising:

a frame including an upper surface and an outer periphery;

a rail coupled to the frame; and an apparatus for reacting a moment on the rail, the apparatus operatively secured to a first position on the rail and configured to apply a first moment on the rail to counteract a second moment applied to the rail;

wherein the apparatus directly contacts the outer periphery of the frame.

2. A rail system according to claim 1, wherein the second moment is applied by a medical instrument mounted to the rail.

3. A rail system according to claim 1, wherein the first moment applied by the apparatus for reacting a moment lengthens a moment arm.

4. A rail system according to claim 1, wherein the rail is coupled to the frame using a at least one bolt and the first moment applied by the apparatus for reacting a moment places the at least one bolt in tension.

5. A rail system according to claim 1, wherein the apparatus for reacting a moment applies a second moment that reacts the first moment along a long axis of the rail.

6. A rail system according to claim 1, wherein the apparatus for reacting a moment applies a second moment that reacts the first moment along a short side of the rail.

7. A rail system according to claim 1, wherein the apparatus comprises:

a rail clamp member;

a base block member moveably coupled to the rail clamp member;

a first fastening device and a second fastening device operatively coupled to the rail clamp member and the base block member and configured to moveably couple the base block member to the rail clamp member;

a fastener disposed within an aperture in the rail clamp member and an aperture in the base block member, the fastener having a first end and second end; and a spacer operatively coupled to the second end of the fastener.

8. A rail system according to claim 7, wherein the spacer is moveable to apply the first moment on the rail.

9. A rail system according to claim 1, wherein the apparatus for reacting a moment comprises:

a base block member, having a first aperture and a second aperture;

a first fastening device disposed within the first aperture;

a spacer operatively coupled to the first fastening device; and a second fastening device disposed within the second aperture.

10. A rail system according to claim 9, wherein the spacer is movable to apply the first moment on the rail.

11. An apparatus for reacting a moment on a rail of a medical table including a frame having an upper surface and an outer periphery, the rail configured to support at least one medical instrument, the apparatus comprising:

a rail clamp member contacting a rail on a medical table;

a base block member moveably coupled to the rail clamp member;

a first fastening device and a second fastening device operatively coupled to the rail clamp member and the base block member and configured to moveably couple the base block member to the rail clamp member;

a fastener disposed within an aperture in the rail clamp member and an aperture in the base block member, the fastener having a first end and second end; and a spacer operatively coupled to the second end of the fastener and movable to apply a first moment to react a second moment on the rail of the medical table, wherein the spacer contacts the outer periphery of the frame.

12. An apparatus according to claim 11, wherein the first fastener and the second fastener are thumb screws.

13. An apparatus according to claim 11, wherein the first moment applied by spacer lengthens a moment arm.

14. An apparatus according to claim 11, wherein the first moment applied by the spacer reacts the second moment along a long axis of the rail.

15. An apparatus according to claim 11, wherein the first moment applied by the spacer reacts the second moment along a short side of the rail.

16. An apparatus for reacting a moment on a rail of a medical table, the rail configured to support at least one medical instrument, the apparatus comprising a base block member, having a first aperture and a second aperture;

a first fastening device disposed within the first aperture;

a spacer operatively coupled to the first fastening device and movable to apply a first moment to react a second moment on the rail of the medical table, wherein the spacer contacts an outer periphery of the medical table, wherein the outer periphery is separate from the upper surface of the frame; and a second fastening device disposed within the second aperture to attach the base block to the rail.

17. An apparatus according to claim 16, wherein the first fastening device and the second fastening device are thumb screws.

18. An apparatus according to claim 16, wherein the first moment applied by a spacer lengthens a moment arm.

19. An apparatus according to claim 16, wherein the first moment applied by the spacer reacts the second moment along a long axis of the rail.

20. An apparatus according to claim 16, wherein the first moment applied by the spacer reacts the second moment along a short side of the rail.

* * * * *